US007553002B2

(12) United States Patent
Baek

(10) Patent No.: US 7,553,002 B2
(45) Date of Patent: Jun. 30, 2009

(54) INK-JET PRINTHEAD

(75) Inventor: Oh-hyun Baek, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/603,991

(22) Filed: Nov. 24, 2006

(65) Prior Publication Data

US 2007/0064033 A1 Mar. 22, 2007

Related U.S. Application Data

(62) Division of application No. 10/452,943, filed on Jun. 3, 2003, now abandoned.

(30) Foreign Application Priority Data

Oct. 30, 2002 (KR) ..... 2002-66575

(51) Int. Cl.
*B41J 2/05* (2006.01)

(52) U.S. Cl. ..... 347/56; 347/67

(58) Field of Classification Search ..... 347/9, 347/56, 67; 257/529, 530
See application file for complete search history.

(56) References Cited

U.S. PATENT DOCUMENTS 5,302,546 A * 4/1994 Gordon et al. ..... 438/10
5,565,702 A * 10/1996 Tamura et al. ..... 257/530
6,336,713 B1 1/2002 Regan et al.
6,390,589 B1 * 5/2002 Imanaka et al. ..... 347/19
6,512,284 B2 * 1/2003 Schulte et al. ..... 257/530
2002/0126182 A1 9/2002 Miyamoto

FOREIGN PATENT DOCUMENTS

EP 000571093 11/1993

* cited by examiner

*Primary Examiner*—Manish S Shah
*Assistant Examiner*—Geoffrey Mruk
(74) *Attorney, Agent, or Firm*—Staas & Halsey LLP

(57) ABSTRACT

An ink-jet printhead including a substrate, in which an integrated circuit for a driving logic circuit to selectively drive the nozzle, and a logic circuit to input/output printing data to/from a fuse array, are formed. The printhead further includes an electrode which is used for wirings of the integrated circuit and the logic circuit and is patterned on the substrate, a plurality of heaters which are formed on the electrode and generate heat by current applied through the electrode from the integrated circuit, and a fuse array which includes a plurality of fuse members formed on the electrode on a same plane with the heater and selectively fused by current applied through the electrode from the logic circuit and stores printing data. The printhead further includes a cover member which is provided on the heater and the fuse array and in which an ink chamber and a nozzle are formed in a position corresponding to each of the heaters.

11 Claims, 8 Drawing Sheets

INK-JET PRINTHEAD

CROSS-REFERENCE TO RELATED APPLICATION

This application is a Divisional of application Ser. No. 10/452,943 filed Jun. 3, 2003 now abandoned, which claims the priority benefit of Korean Patent Application No. 2002-66575, filed Oct. 30, 2002, in the Korean Intellectual Property Office, the disclosures of which are incorporated herein by reference.

BACKGROUND OF THE INVENTION

1. Field of the Invention

The present invention relates to an ink-jet printhead, and more particularly, to an ink-jet printhead having a fusing-type data input/output capability.

2. Description of the Related Art

In general, ink-jet printheads are devices to print a predetermined color image by ejecting small volumes of droplets of printing ink at desired positions on a recording sheet. These ink-jet printheads are divided by two driving methods according to the ink ejection mechanism. First, ink-jet printheads may use a thermal driving method, which eject ink droplets by the expansion force of bubbles generated in ink by a heat source. Also, ink-jet printheads may use a piezoelectric driving method, which eject ink droplets by the pressure applied to ink due to the deformation of a piezoelectric body.

Hereinafter, the ink ejection mechanism in the thermal ink-jet printheads will be described in greater detail. When current having a pulse shape flows through a heater formed of a resistant heating material, heat is generated in the heater, and ink adjacent to the heater is instantaneously heated to about 300° C. As such, ink is boiled, and bubbles are generated in the ink, expand, and apply pressure to an inside of an ink chamber filled with the ink. As a result, the ink in the vicinity of a nozzle is ejected in a droplet shape through the nozzle from the ink chamber.

Here, the thermal driving method includes a top-shooting method, a side-shooting method, or a back-shooting method according to a growth direction of the bubbles and an ejection direction of the ink droplets.

The top-shooting method is a method in which the growth direction of the bubbles is the same as the ejection direction of the ink droplets. The side-shooting method is a method in which the growth direction of the bubbles is perpendicular to the ejection direction of the ink droplets. The back-shooting method is a method in which the growth direction of the bubbles is opposite to the ejection direction of the ink droplets.

The ink-jet printheads using the thermal driving method should satisfy the following requirement. First, manufacturing of the ink-jet printheads must be simple, costs must be low, and mass production thereof must be possible. Second, in order to obtain a high-quality image, crosstalk between adjacent nozzles must be suppressed and an interval therebetween has to be narrow. That is, in order to increase the number of dots per inch (DPI), a plurality of the nozzles must be arranged with narrow intervals therebetween. Third, in order to perform a high-speed printing operation, a period in which the ink chamber is refilled with ink after being ejected from the ink chamber must be as short as possible, and heated ink must be quickly cooled such that a driving frequency can increase.

Currently, ink-jet printheads have been developing so as to realize high printing resolution and high-speed printing. For this purpose, ink-jet printheads having several hundreds or more of nozzles of small sizes have been developed.

Meanwhile, various driving circuits to drive the nozzles and various digital logic circuits to address the nozzles are being embedded in a printhead chip. As such, various important electrical characteristics inside the head chip must be accurately controlled. These values include resistance of the heater to generate the bubbles in the ink-jet printhead, impedance of a metal-oxide semiconductor field effect transistor (MOS FET) to drive the nozzles and a temperature constant of a temperature sensor. These characteristics have a predetermined range of distribution according to several variables in a semiconductor manufacturing process of the head chip. In order to accurately drive and control several hundreds of the nozzles, the above-mentioned characteristic values are memorized for each head chip, and desired performances can be achieved only when the printhead is driven under optimized conditions in which these characteristic values are considered.

For this purpose, at an initial stage, by attaching an additional electrically erasable and programmable read only memory (EEPROM) to an ink cartridge, the above-mentioned electric characteristic values are recorded, and an identity (ID) code of the head chip or ink retaining quantity in an ink tank are memorized. However, if an additional EEPROM is used, when the head chip is manufactured and finished at a wafer level, it is impossible to measure electrical characteristics and input values thereof during an inspection process. In this case, the above characteristic values have to be input after the cartridge is manufactured. Thus, productivity decreases, and due to additional parts, costs increase.

In order to solve these problems, a read only memory (ROM) to store data is manufactured together in a driving circuit portion when the printhead chip is manufactured. However, the number of additional semiconductor manufacturing processes to implement a ROM circuit increases in a driving MOS circuit of the printhead, thereby increasing costs of the head chip.

Recently, considering that the input capability of electrical data is not large, by using a fusing-type data recording method other than a conventional ROM method, a memory device can be implemented in the head chip without an additional process. As a result, an ink-jet printhead using the thermal driving method, by which ink is sprayed by bubbles generated by heating ink, includes a plurality of heaters to heat the ink, a driving FET array, a digital logic circuit to address each of the heaters, and connection pads. Furthermore, the printhead includes a fuse array which records data such as resistance of the heaters, impedance of the MOS FET, and an ID code of the head chip forms a part of the head chip.

In order to input data into the fuse array, fusing of a fuse member to form the fuse array is necessary. In order to fuse the fuse member with the least energy, it is important to properly select the material, shape, and thickness of the fuse member.

In general, a material used for the fuse member is the same as the material of an electrode formed under a heater layer to eject ink, or as the heater. In order to fuse the fuse member, a predetermined amount of current must flow through the fuse member.

If the material of the fuse member is the same as the material of the electrode, resistance of the fuse member is very small ($Rs<0.1\Omega/\square$). Thus, in order to form a resistant body, a very long wiring pattern has to be formed. Thus, the size of the head chip is increased. Also, if the wiring is placed so that a long wiring is inserted in a limited space, edges occur due to change of direction. Thus, if errors of shape occur in the edges, the wiring may be disconnected even at a noise voltage having a small value.

On the other hand, if the material of the fuse member is the same as the material of the heater, resistance of the heater is comparatively high (Rs≅several tens of Ω/□). Thus, the wiring of the fuse member does not need to be formed having a long shape. Part of a vertical structure of a conventional ink-jet printhead having such a fuse array is schematically shown in FIG. 1. Referring to FIG. 1, a fuse array 110 formed of a plurality of fuse members 103, an insulating layer 104, a fuse electrode 105, and a passivation layer 106 are sequentially formed on a base substrate 102 of the ink-jet printhead. A cover member 107 is formed on the passivation layer 106.

In the above structure, the fuse array 110 stores various data by selectively fusing the fuse members 103. Thus, heat is generated by the fuse members 103, and due to the heat, cracks 190 occur in the insulating layer 104 or the passivation layer 106 formed on the fuse members 103. Thus, if ink 108 or external moisture penetrates into the fuse members 103 through the cracks 190, the fuse members 103 may be disconnected or the fuse electrode 105 may be corroded.

FIG. 2 illustrates part of a vertical structure of a ink-jet printhead having a fuse array, which is disclosed in U.S. Pat. No. 6,390,589. Referring to FIG. 2, a fuse array 441 formed of a plurality of fuse members 440 is formed on a base substrate 410, and an insulating layer 450 is deposited on the fuse array 441. A fuse electrode 443 is formed on the insulating layer 450 and is connected to the fuse members 440 via a through hole formed on the insulating layer 450. A passivation layer 452 for insulation is formed on the fuse electrode 443. Also, in order to prevent the passivation layer 452 from being damaged when the fuse members 440 are fused, an anti-cavitation film 453 is formed on the top surface of the passivation layer 452. A cover member including a sealing member 460 and a cover substrate 461 is formed on the top surface of the anti-cavitation film 453.

Here, the fuse members 440 are formed of a material which is the same as the material of a heater for ejecting ink, and a metal layer connected to the heater is used for the fuse electrode 443 such that the fuse array 441 is manufactured without introducing an additional process.

However, since the fuse array 441 is not in contact with the ink, there are limitations in designing a head chip, and due to separation of an ink passage layer which may occur when a printer is used in a bad environment, the ink and external moisture cannot be prevented from penetrating into the fuse member 440.

SUMMARY OF THE INVENTION

Accordingly, it is an aspect of the present invention to provide an ink-jet printhead having an improved structure of a fuse array which is a fusing-type data recording device by which a printhead chip is prevented from being damaged when a fuse member is fused.

It is another aspect of the present invention to improve the structure of a fuse array, which is a fusing-type data recording device, such that a printhead chip is prevented from being damaged when a fuse member is fused.

Additional aspects and advantages of the invention will be set forth in part in the description which follows and, in part, will be obvious from the description, or may be learned by practice of the invention.

The foregoing and/or other aspects of the present invention are achieved by providing an ink-jet printhead which ejects ink through a nozzle by heating ink filled in an ink chamber and generating bubbles in the ink. The printhead includes a nozzle to eject heated ink; an ink chamber to store the ink during heating to generate bubbles therein; a fuse array; a substrate in which an integrated circuit for a driving logic circuit to selectively drive the nozzle and a logic circuit to input/output printing data to/from the fuse array are formed; an electrode to form wirings of the integrated circuit and the logic circuit and being patterned on the substrate; a heater formed on the electrode to generate heat by a current applied through the electrode from the integrated circuit; and a cover member which is provided on the heater and the fuse array and in which the ink chamber and the nozzle are formed in a position corresponding to the heater, wherein the fuse array includes a plurality of fuse members formed on the electrode on a same plane with the heater and is selectively fused by a current applied through the electrode from the logic circuit, to store printing data.

The fuse array may be formed of Ti or TiN, Ta, TaN, or TaAl. The fuse array may be deposited by sputtering, and the thickness of the fuse array is 500 to 1500 Å.

The printhead may further include an insulating layer formed on the top surface of the fuse array. For example, the insulating layer may be formed of $SiN_x$.

Also, the printhead may further include an anti-cavitation layer formed on the top surface of the insulating layer. The anti-cavitation layer may be formed of Ta, Ti, or TiN.

The foregoing and/or other aspects of the present invention may also be achieved by providing an ink-jet printhead including a nozzle to eject heated ink; an ink chamber to store the ink during heating to generate bubbles therein; a fuse array; a substrate in which an integrated circuit for a driving logic circuit to selectively drive the nozzle and a logic circuit to input/output printing data to/from the fuse array are formed; an electrode to form wirings of the integrated circuit and the logic circuit and being patterned on the substrate; a heater formed on the substrate to generate heat by a current applied through the electrode from the integrated circuit, the wirings also being patterned on the heater; and a cover member which is provided on the heater and the fuse array and in which the ink chamber and the nozzle are formed in a position corresponding to the heater, wherein the fuse array includes a plurality of fuse members formed on the electrode and is selectively fused by a current applied through the electrode from the logic circuit, to store printing data.

The fuse array may be formed of Ti or TiN, Ta, TaN, or TaAl, and may be deposited by sputtering.

The printhead may further include an insulating layer formed on the top surface of the fuse array. The insulating layer may be formed of $SiN_x$.

Also, the printhead may further include an anti-cavitation layer formed on the top surface of the insulating layer. The anti-cavitation layer may be formed of Ta, Ti, or TiN.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
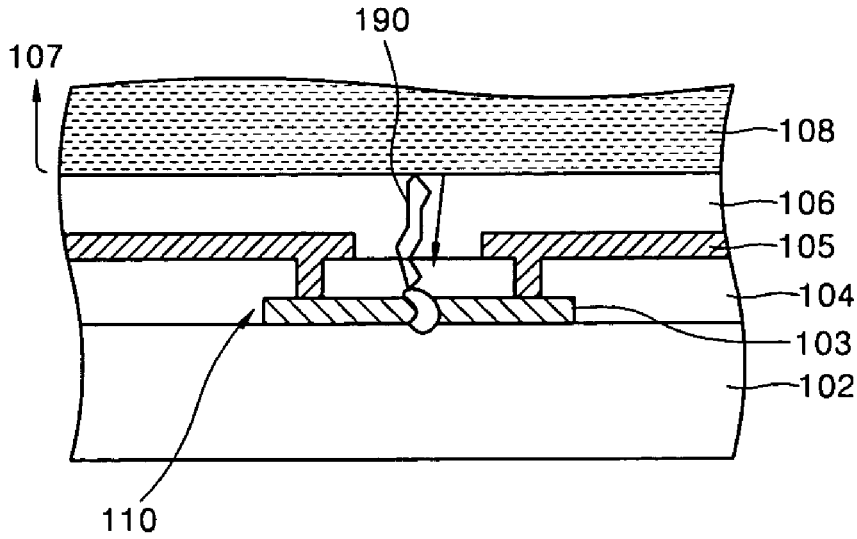
FIG. 1 (PRIOR ART)
FIG. 1 is a cross-sectional view schematically illustrating part of a vertical structure of a conventional ink-jet printhead.
Figure 2:
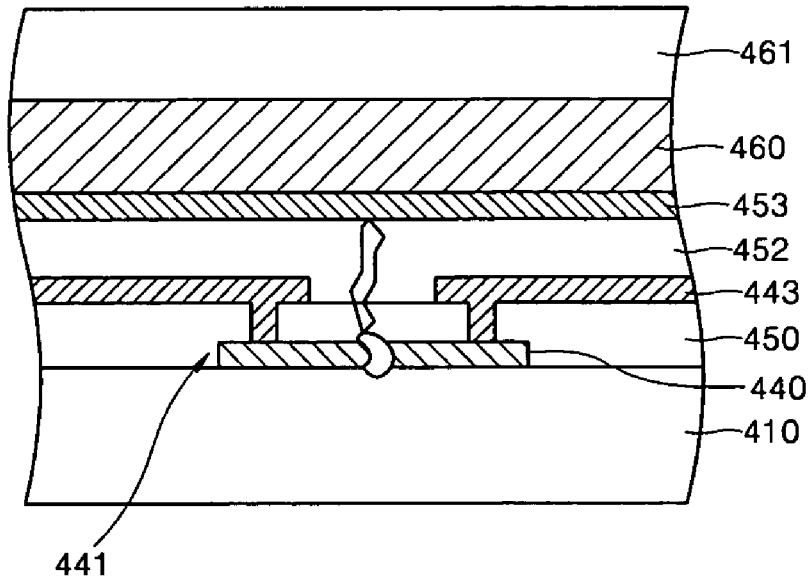
FIG. 2 (PRIOR ART)
FIG. 2 is a cross-sectional view schematically illustrating part of a vertical structure of another conventional ink-jet printhead.

Reference will now be made in detail to the present preferred embodiments of the present invention, examples of which are illustrated in the accompanying drawings, wherein like reference numerals refer to like elements throughout.

The size and thickness of elements in the FIGS. may be exaggerated for clarity of explanation. Furthermore, when a layer is referred to as being on another layer or on a substrate, it can be directly on the other layer or on the substrate, or intervening layers may also be present.

Figure 3:
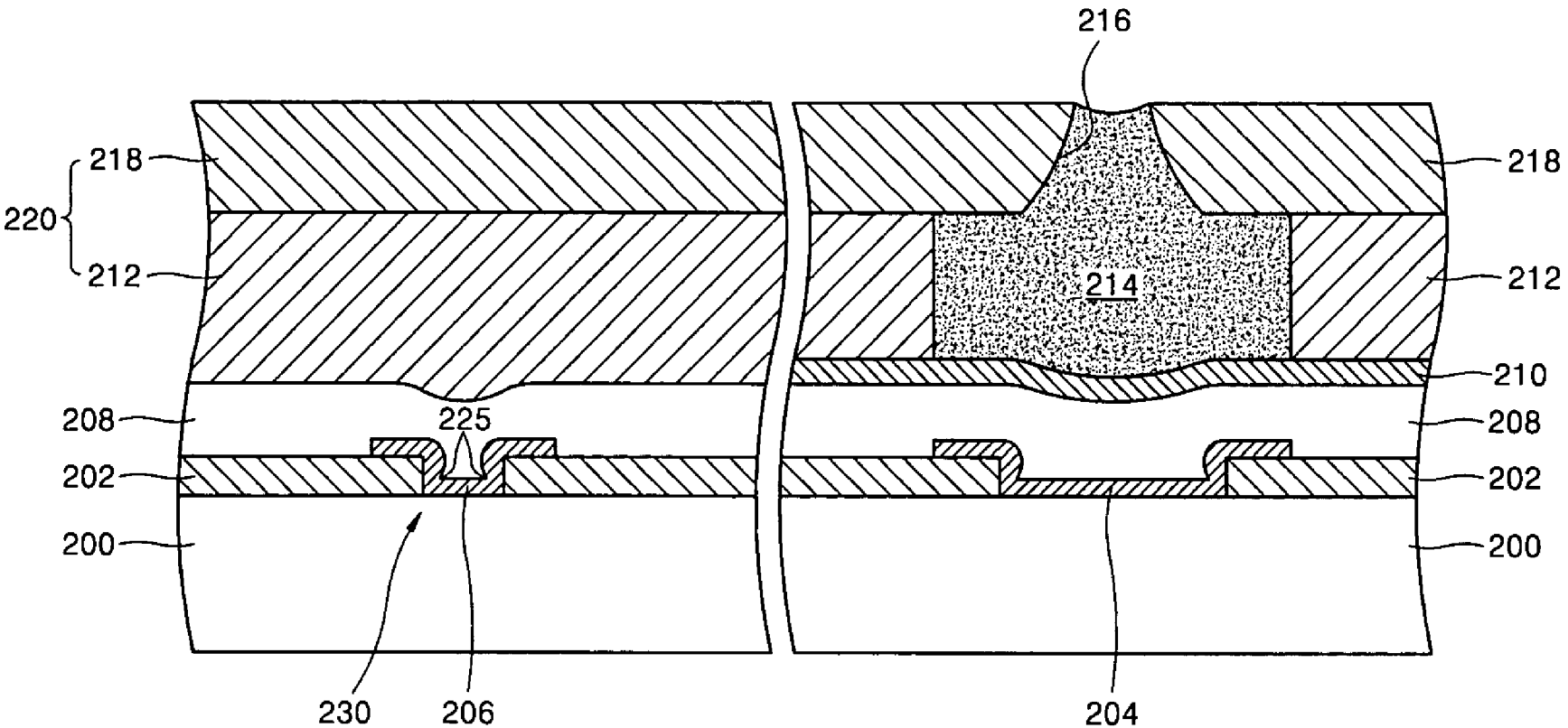
FIG. 3 is a cross-sectional view schematically illustrating part of a vertical structure of an ink-jet printhead according to an embodiment of the present invention.

FIG. 3 is a cross-sectional view schematically illustrating a vertical structure of an ink-jet printhead according to an embodiment of the present invention. Referring to FIG. 3, the ink-jet printhead includes a substrate 200, an electrode 202 formed on the substrate 200, a heater 204 and a fuse array 230 formed on the electrode 202, and a cover member 220 formed on the heater 204 and the fuse array 230.

In general, a silicon substrate is used for the substrate 200. This is because a silicon wafer that is widely used to manufacture semiconductor devices can be used and thus is effective in mass production.

Meanwhile, although not shown, an integrated circuit for a driving logic circuit for addressing a nozzle 216 and applying a current, and a logic circuit to input/output printing data to/from a fuse array are formed in the substrate 200. In general, complementary MOS (CMOS) devices are used for these circuits. Specifically, a p-well and an n-well having high and low concentrations are formed on the substrate 200, and then, a gate is formed on a gate oxide layer, thereby completing a MOS FET. An insulating layer formed of a material such as boro-phosphorous silicate glass (BPSG), SiN, or $Sio_2$, is deposited on the MOS FET.

The electrode 202 is formed on the insulating layer. The electrode 202 is used for a wiring of the MOS circuit and is formed by patterning metals which have a good conductivity and can be easily patterned, such as aluminum or aluminum alloy, by a photolithography process and an etch process. Here, the electrode may be formed to a thickness of about 3000-7000 Å. Meanwhile, if due to the complexity of the wiring, the electrode 202 is superimposed on another electrode, the electrode 202 may be formed of two layers or three layers. In this case, an insulating layer for insulation is formed between the layers. When the electrode 202 is formed of multiple layers, the uppermost electrode 202 is connected to the fuse array 230. A plurality of the heaters 204 and the fuse array 230 are formed in an etched portion of the electrode 202.

Figure 4:
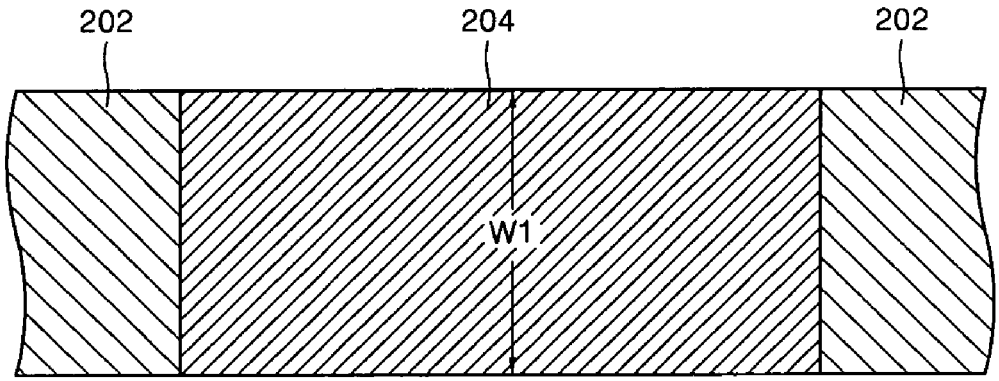
FIG. 4 is a plane view of the heater shown in FIG. 3.

The heater 204 is a resistant heating body which generates heat by applied current through the electrode 202 from an integrated circuit. The heater 204 may be formed of a material such as Ti, TiN, Ta, TaN, or TaAl. A width W1 of the heater 204 (FIG. 4) is about 25 μm.

Figure 5:
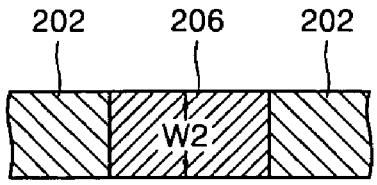
FIG. 5 is a plane view of the fuse member shown in FIG. 3.

The fuse array 230 is formed of a plurality of fuse members 206, and thus is selectively fused by applied current through the electrode 202 from the logic circuit, thereby recording printing data. The fuse member 206 forming the fuse array 230 may be deposited simultaneously with the heater 204. In this case, the material used for the fuse member 206 is the same as the material of the heater 204. Thus, the fuse member 206 is formed of Ti, TiN, Ta, TaN, or TaAl. A width W2 of the fuse member 206 is several pm, as shown in FIG. 5.

A sheet resistance $R_s$ must have a value of about 30-70 Ω/□ so that the fuse member 206 is fused at a voltage of about 5V. Thus, the thickness of the fuse member 206 is about 500-1500 Å.

Meanwhile, the fuse member 206 is formed of a material that is widely used in a MOS process, and is deposited by sputtering, which is a sort of physical vapor deposition (PVD). However, due to deposition characteristics by sputtering, an edge 225 having a thickness smaller than other portions of the fuse member 206 is formed under the etched electrode 202. The edge 225 of the fuse member 206 plays an important role when the fuse member 206 is fused.

An insulating layer 208 is formed on the top surface of the heater 204 and the fuse array 230. The insulating layer 208 may be formed of $SiN_x$. In particular, when the heater 204 is formed of TiN, the SiNx insulating layer 208 may be commonly formed on the top surface of the heater 204 and the fuse array 230.

An anti-cavitation film 210 is formed on the top surface of the insulating layer 208 formed toward the heater 204 so as to prevent the insulating layer 208 from being damaged by bubbles generated from ink filled in an ink chamber 214.

The cover member 220 is provided on the insulating layer 208 and the anti-cavitation film 210. The cover member 220 includes a barrier wall 220 for defining the ink chamber 214 filled with ink, and a nozzle plate 218 which forms an upper wall of the ink chamber 214. The ink chamber 214 is formed in a position which corresponds to each of the heaters 204 and is connected to an ink reservoir (not shown). The nozzle 216 through which ink filled in the ink chamber 214 is ejected, is formed in the nozzle plate 218.

Figure 6A:
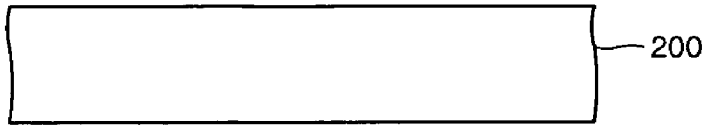
FIGS. 6A through 6E show operations for forming a fuse array of FIG. 3.
Figure 6B:
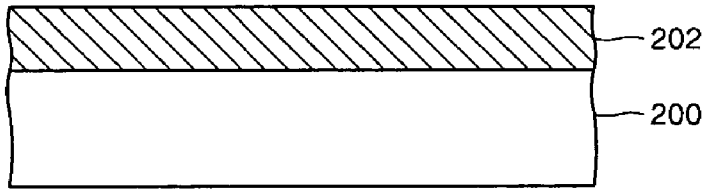
Figure 6C:
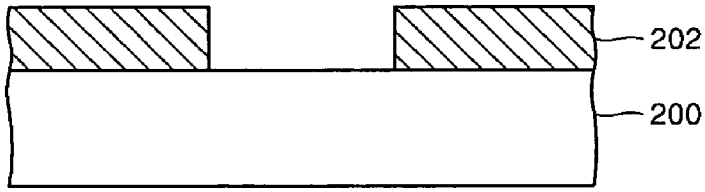
Figure 6D:
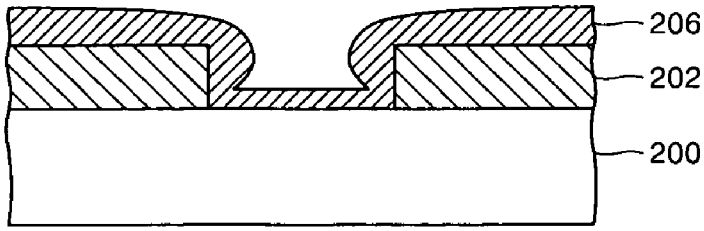
Figure 6E:
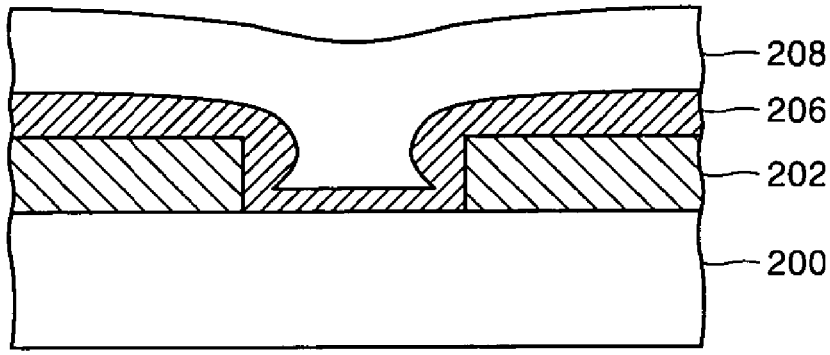

FIGS. 6A through 6E show a process of forming the fuse array 230 in the ink-jet printhead shown in FIG. 3. Referring to FIGS. 6A through 6E, the substrate 200 is prepared (FIG. 6A). An integrated circuit for a driving logic circuit to address the nozzle (216 of FIG. 3) and apply current and a logic circuit to input/output printing data to/from the fuse array (230 of FIG. 3) are formed on the substrate. Next, the electrode 202 used for wirings of the integrated circuit and the logic circuit is deposited on the substrate 200 (FIG. 6B). Subsequently, in order to form the fuse member 206 on the electrode 202, a portion in which the fuse member 206 is to be placed, is patterned by a photolithography process and an etch process (FIG. 6C). Simultaneously, a portion in which the heater 204 is to be placed, is patterned. Next, the fuse member 206 is deposited on the patterned electrode 202 by sputtering (FIG. 6D). Simultaneously, the heater 204 is deposited on the patterned electrode 202. Subsequently, the insulating layer 208 is deposited on the top surface of the deposited fuse member 206 and the heater 204 (FIG. 6E).

In the above structure, a printing operation is performed as follows: first, a central processing unit (CPU) (not shown) reads printing data recorded in the fuse array 230. Next, the CPU transmits a control signal to a driving logic circuit, and the driving logic circuit which receives the control signal selectively drives the nozzle 216 to eject ink through the nozzle 216.

Meanwhile, in order to record printing data in the fuse array 230, a plurality of the fuse members 206 have to be selectively fused, and binary data must be recorded in the plurality of fuse members 206 through the following procedure. First, if a predetermined voltage is applied to the electrode 202 through the logic circuit, the current flows through the fuse member 206 through the electrode 202. For example, when the fuse member 206 is formed of TiN, resistance thereof is about 30-70 Ω, and thus, if a 5V voltage is applied to the electrode 202, a current of several hundred mA flows through the fuse member 206. Thus, if the width of the fuse member 206 is set to be less than several μm, the fuse member 206 is heated and fused. Meanwhile, since a sheet resistance $R_s$, of the electrode 202 is less than 0.1 Ω/□, a TiN member serves as a resistance body. As such, heat is usually generated only in the TiN member. Thus, the TiN member may also be used for the heater 204 to eject ink.

If the current is applied to the fuse member 206, the weakest portion of the fuse member 206 is damaged. Thus, due to step coverage caused by deposition of the fuse member 206, failure occurs in the edge 225 in which the bottom side and vertical side of the fuse member 206 cross each other.

Figure 7:
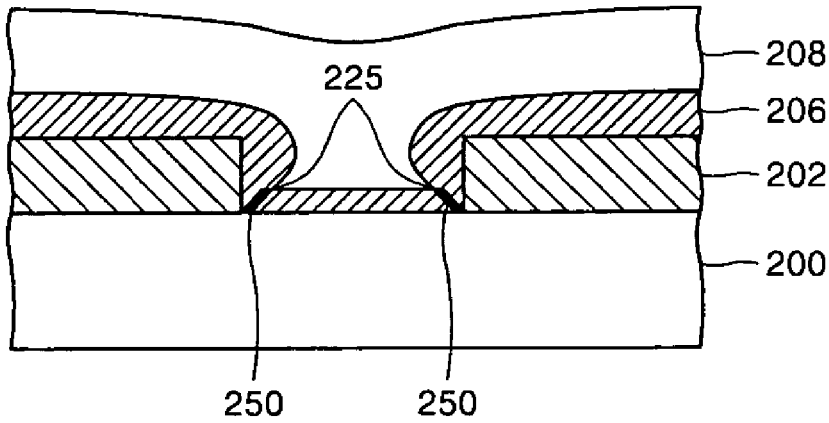
FIG. 7 shows a damaged fuse member of FIG. 3.

Damage occurring in the edge 225 of the fuse member 206 is propagated in a direction where the thickness of a layer is the thinnest and edge characteristics are strong. In conclusion, as shown in FIG. 7, damage 250 (i.e., cracks) occurs in a direction inclined from the bottom side of the fuse member 206. As such, sparks or other shocks which occur when the fuse member 206 is fused, are propagated into a side of the insulating layer 208 formed on the top surface of the fuse member 206 such that it is possible for the insulating layer 208 to be damaged more.

Figure 8:
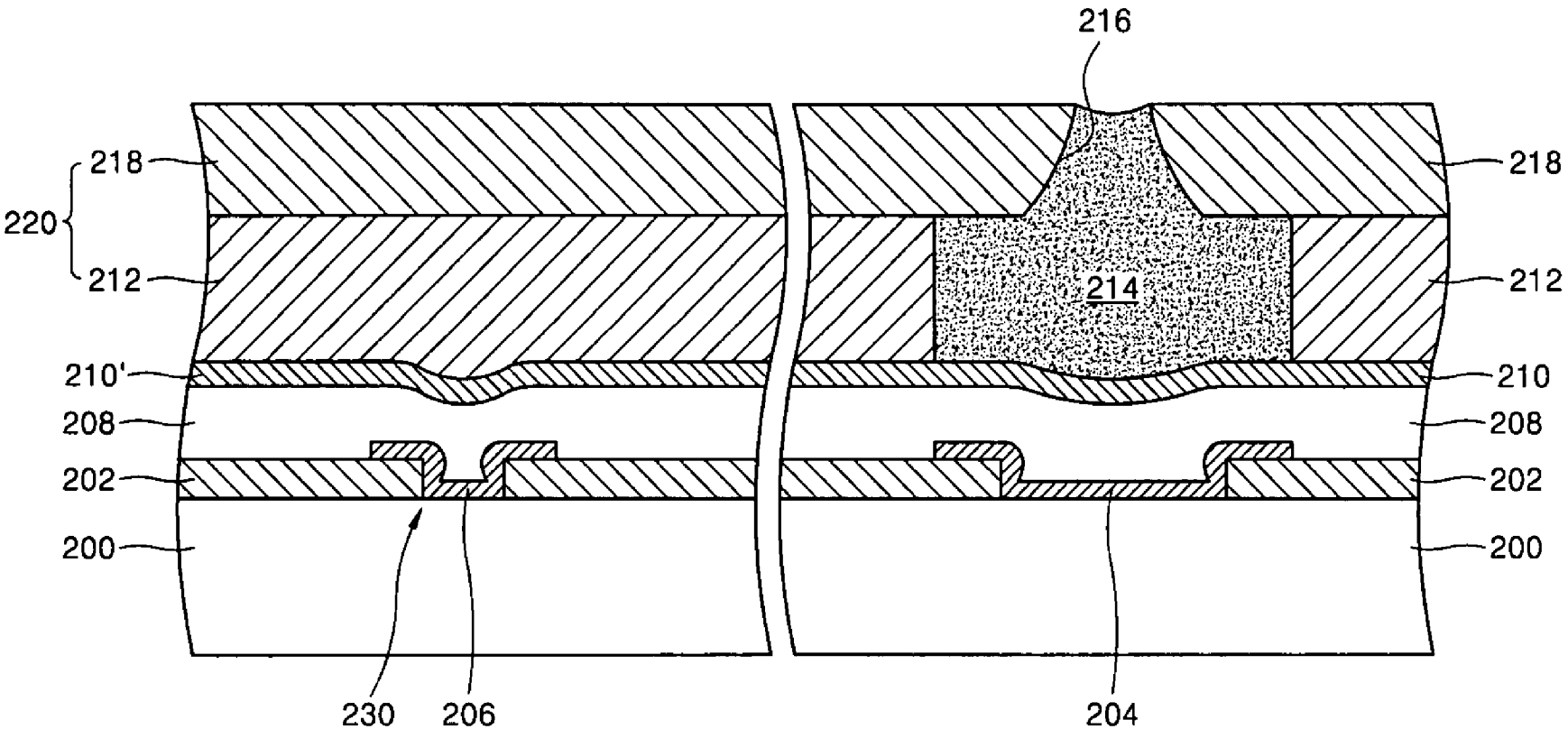
FIG. 8 is a cross-sectional view schematically illustrating the vertical structure of the ink-jet printhead according to the embodiment of the present invention shown in FIG. 3, in which an anti-cavitation layer is formed on the fuse array.

Meanwhile, as shown in FIG. 8, if an anti-cavitation layer 210' is formed even on the top surface of the insulating layer 208 on which the fuse array 230 is formed, the fuse member 206 and the electrode 202 are prevented from being damaged by ink filled in the ink chamber 214. As such, an ink-jet printhead having a more reliable structure can be manufactured. Here, the anti-cavitation layer 210' is formed of Ta, Ti, or TiN.

Figure 9:
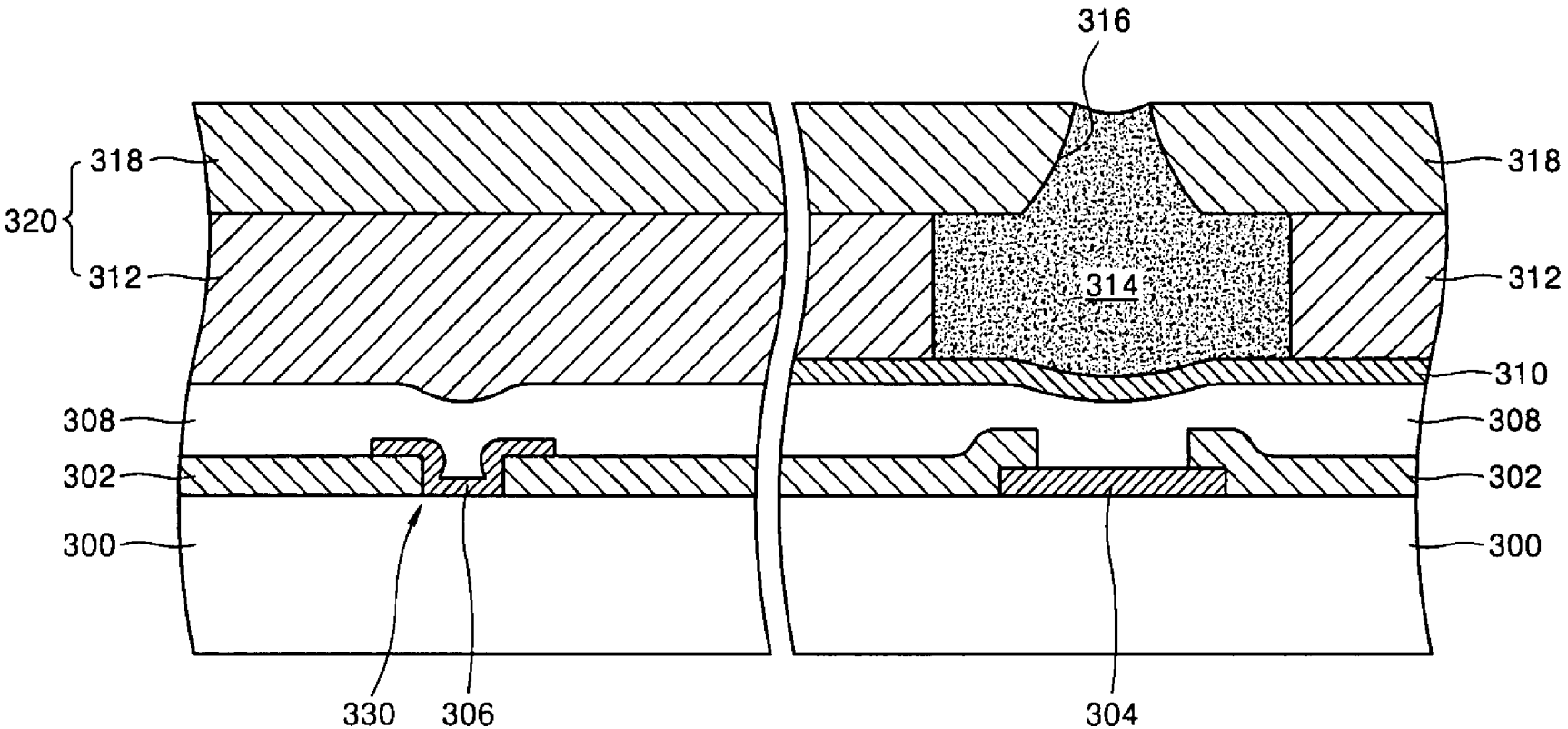
FIG. 9 is a cross-sectional view schematically illustrating a vertical structure of the ink-jet printhead according to another embodiment of the present invention.

FIG. 9 is a cross-sectional view schematically illustrating an embodiment of a vertical structure of an ink-jet printhead according to the present invention. Referring to FIG. 9, the ink-jet printhead includes a substrate 300, a plurality of heaters 304 formed on the substrate 300, an electrode 302 patterned on the substrate 300 and the heaters 304, a fuse array 330 formed on the electrode 302, an insulating layer 308 formed on the top surface of the heater 304, the electrode 302, and the fuse array 330, and a cover member 320 provided on the insulating layer 308.

Figure 10:
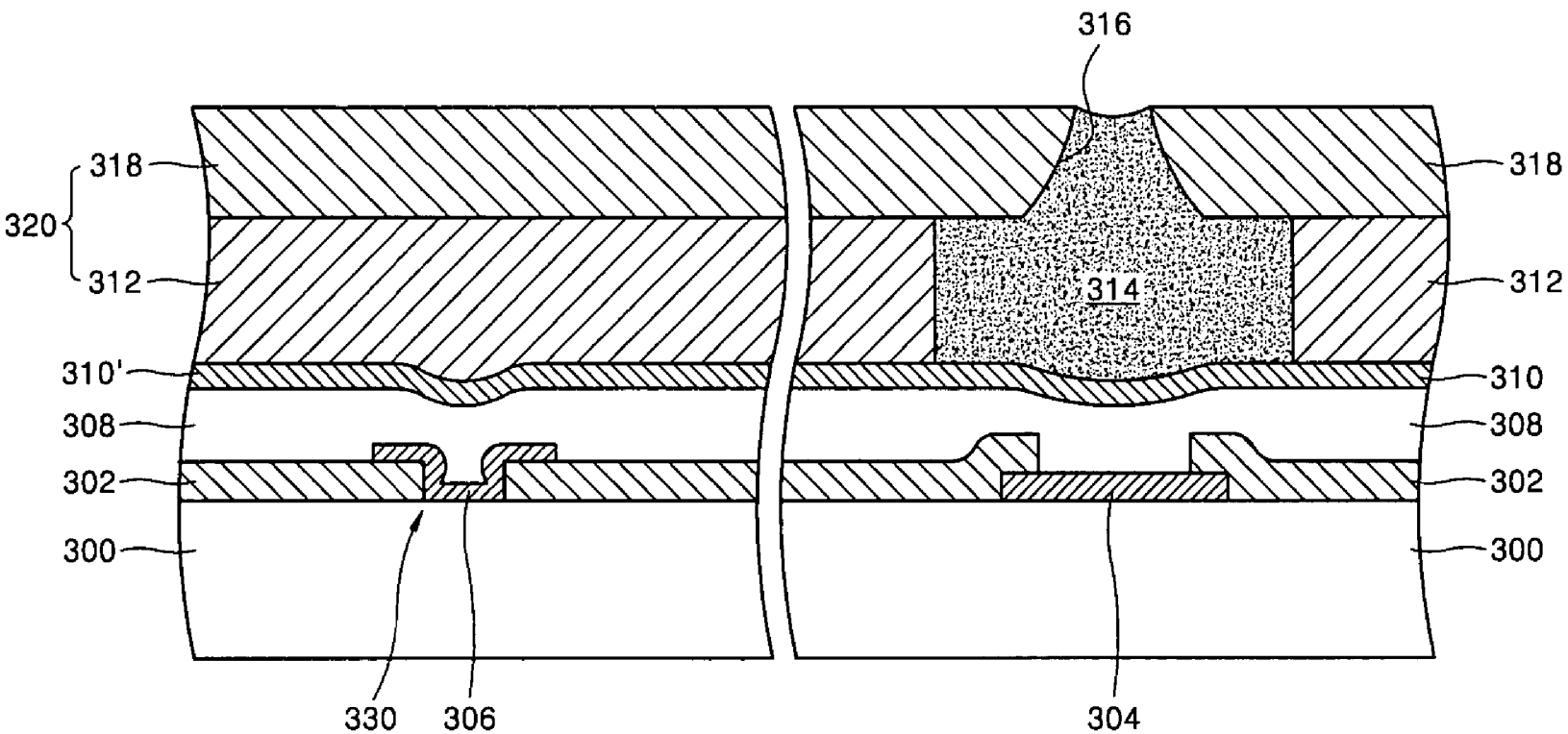
FIG. 10 is a cross-sectional view schematically illustrating the vertical structure of the ink-jet printhead according to the embodiment of the present invention shown in FIG. 9, in which an anti-cavitation layer is formed on the fuse array.

An integrated circuit for a driving logic circuit for addressing a nozzle 316 and applying current, and a logic circuit to input/output printing data to/from the fuse array 330 are formed in the substrate 300. The heaters 304 are resistant bodies which generate heat by current applied through the electrode 302 from the above-mentioned integrated circuit and are formed on the substrate 300. The electrode 302 is used for wirings of the integrated circuit and the logic circuit and are patterned on the top surface of the substrate 300 and the heaters 304. A plurality of fuse members 306 which form the fuse array 330 are deposited on the patterned electrode 302 by sputtering. The fuse array 330 is selectively fused by applied current through the electrode from the logic circuit, and printing data is stored in the fuse array 330. The insulating layer 308 is formed on the top surfaces of the heaters 304, the electrode 302, and the fuse array 330. Meanwhile, an anti-cavitation layer 310 is formed on the top surface of the insulating layer 308 formed toward the heaters 304 so as to prevent the insulating layer 308 from being damaged by bubbles generated from ink filled in an ink chamber 314. The cover member 320 is provided on the insulating layer 308 and the anti-cavitation layer 310. The cover member 320 includes a barrier wall 312 for defining the ink chamber 314 and a nozzle plate 318 which forms an upper wall of the ink chamber 314. The nozzle 316 through which ink filled in the ink chamber 314 is ejected, is formed in the nozzle plate 318. Here, materials used for the substrate 300, the heaters 304, the electrode 302, the fuse members 306, the insulating layer 308, and the anti-cavitation layer 310 are the same as the materials described in the first embodiment, and thus, descriptions thereof will be omitted. Meanwhile, as shown in FIG. 10, if an anti-cavitation layer 310' is formed even on the top surface of the insulating layer 308 on which the fuse array 330 is formed, the fuse members 306 and the electrode 302 are prevented from being damaged by ink filled in the ink chamber 314. As such, an ink-jet printhead having a more reliable structure can be manufactured. Here, the anti-cavitation layer 310' may be formed of Ta, or Ti, or TiN.

As described above, the ink-jet printhead according to the embodiment of the present invention has the following advantages.

First, if a coverage operation is forcibly formed on an electrode formed on a substrate by depositing a fuse member by physical vapor deposition (PVD), damage occurs in a direction inclined from a bottom side of the fuse member when the fuse member is fused. As such, a reliable ink-jet printhead, which can absorb most of the shocks occurring when the fuse member is fused, can be achieved. Second, because of the reliability as described above, there is no need to place a fuse array to avoid contact with the ink. Third, when the fuse member is formed as the same layer as a heater, a process for manufacturing a printhead can be simplified. Fourth, since the fuse member is used for a resistant body, the size of the fuse member can be reduced. Fifth, when the fuse member is formed of Ti or TiN, it is easy to form a resistant body, and an additional serial resistance is not needed, and the size of the fuse member can be reduced. In addition, Ti or TiN used for the fuse member is widely used to manufacture semiconductor devices such as MOS FET devices, and thus, an ink-jet printhead can be easily manufactured without additional equipment investment and process development.

Although a few embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An ink-jet printhead comprising:

a chamber to store ink; and a plurality of fuses to be selectively fused to store printing data, the fuses each having a fuse member with a first surface and a second surface, the first surface being curved and substantially vertical and the second surface being a bottom surface spaced away from the ink relative to the first surface, wherein damage occurring in the fuses when being fused is inclined relative to the second surface so as not to propagate outside of the fuses and occurs in an edge defined by the first and second surfaces where the first surface and second surface of the fuse member intersect each other.

2. The printhead of claim 1 wherein the ink does not contact the fuses when the damage occurs.

3. The printhead of claim 1, further comprising:

a plurality of nozzles;

a plurality of heaters, corresponding to the nozzles, to generate heat in the ink to form bubbles therein to discharge the ink through the nozzles in accordance with the printing data; and an electrode formed on a same plane as the heaters.

4. The printhead of claim 3, wherein the electrode is formed of multiple layers, and the electrode layer closest to the ink is connected to the fuses.

5. The printhead of claim 3, wherein the heaters and the fuses are formed of a same material.

6. The printhead of claim 3, wherein a resistance of each of the fuses is 30-70 Ω/□ and a thickness of each of the fuses is 500-1500 Å.

7. The printhead of claim 3, wherein the edge has a thickness smaller than other portions of the fuse member, the edge being formed under the electrode.

8. The printhead of claim 3, further comprising:

an insulating layer formed on the heaters;

an anti-cavitation film formed on the insulating layer; and a cover, defining the chamber and the nozzles, provided on the insulating layer and the anti-cavitation film.

9. The printhead of claim 3, wherein the heaters each comprise a single flat portion.

10. The printhead of claim 3, wherein the heaters each comprise a first flat portion and a second flat portion connected thereto.

11. An apparatus comprising:

a fusing-type data recording device including a plurality of fuse members, wherein resulting fuse damage from the fuse members being fused occurs in an edge defined by where a curved and substantially vertical surface of the fuse members and a bottom surface of the fuse members intersect each other.

* * * * *

UNITED STATES PATENT AND TRADEMARK OFFICE

CERTIFICATE OF CORRECTION

PATENT NO. : 7,553,002 B2
APPLICATION NO. : 11/603991
DATED : June 30, 2009
INVENTOR(S) : Oh-hyun Baek It is certified that error appears in the above-identified patent and that said Letters Patent is hereby corrected as shown below:

Column 9, Line 1, change "claim 1" to --claim 1,--.

Column 9, Lines 3-9, change
"3. The printhead of claim 1, further comprising:
a plurality of nozzles;
a plurality of heaters, corresponding to the nozzles, to generate heat in the ink to form bubbles therein to discharge the ink through the nozzles in accordance with the printing data; and an electrode formed on a same plane as the heaters." to
--3. The printhead of claim 1, further comprising:
a plurality of nozzles;
a plurality of heaters, corresponding to the nozzles, to generate heat in the ink to form bubbles therein to discharge the ink through the nozzles in accordance with the printing data; and
an electrode formed on a same plane as the heaters.--.

Signed and Sealed this

Thirteenth Day of October, 2009

David J. Kappos

David J. Kappos
*Director of the United States Patent and Trademark Office*